US008189841B2

(12) United States Patent
Litovsky et al.

(10) Patent No.: US 8,189,841 B2
(45) Date of Patent: May 29, 2012

(54) ACOUSTIC PASSIVE RADIATING

(75) Inventors: Roman N. Litovsky, Newton, MA (US); Faruk Halil Bursal, Lexington, MA (US)

(73) Assignee: Bose Corporation, Framingham, MA (US)

( * ) Notice: Subject to any disclaimer, the term of this patent is extended or adjusted under 35 U.S.C. 154(b) by 995 days.

(21) Appl. No.: 12/056,872

(22) Filed: Mar. 27, 2008

(65) Prior Publication Data

US 2009/0245561 A1 Oct. 1, 2009

(51) Int. Cl.
*H04R 25/00* (2006.01)
*H04R 1/02* (2006.01)
*H04R 1/20* (2006.01)

(52) U.S. Cl. ..... 381/349; 381/182; 381/345

(58) Field of Classification Search ..... 381/345, 381/349, 182, 351

See application file for complete search history.

(56) References Cited

U.S. PATENT DOCUMENTS

| | | | | | |
|---|---|---|---|---|---|
| 1,988,250 | A | | 1/1935 | Olson | |
| 3,727,719 | A | | 4/1973 | Yando | |
| 4,176,253 | A | * | 11/1979 | Gabr | 381/335 |
| 5,073,945 | A | * | 12/1991 | Kageyama et al. | 381/89 |
| 5,253,301 | A | * | 10/1993 | Sakamoto et al. | 381/89 |
| 5,526,456 | A | * | 6/1996 | Heinz | 381/340 |
| 5,590,208 | A | * | 12/1996 | Koyano et al. | 381/338 |
| 5,832,079 | A | | 11/1998 | Rabe | |
| 5,850,460 | A | * | 12/1998 | Tanaka et al. | 381/186 |
| 6,176,345 | B1 | | 1/2001 | Perkins et al. | |
| 6,292,573 | B1 | | 9/2001 | Zurek et al. | |
| 6,389,146 | B1 | * | 5/2002 | Croft, III | 381/345 |
| 6,711,274 | B2 | * | 3/2004 | Asahina et al. | 381/386 |
| 6,744,895 | B2 | * | 6/2004 | Miyamoto et al. | 381/182 |
| 7,046,816 | B2 | * | 5/2006 | Vandersteen | 381/182 |
| 7,106,878 | B2 | | 9/2006 | Saiki et al. | |
| 7,133,533 | B2 | * | 11/2006 | Chick et al. | 381/349 |
| 7,162,050 | B2 | * | 1/2007 | Furuya et al. | 381/351 |
| 7,385,482 | B2 | * | 6/2008 | Wada | 340/384.1 |
| 7,508,933 | B2 | * | 3/2009 | Yang | 379/433.02 |
| 2002/0061114 | A1 | * | 5/2002 | Croft, III | 381/345 |
| 2002/0076062 | A1 | * | 6/2002 | Juszkiewicz et al. | 381/89 |
| 2004/0035635 | A1 | | 2/2004 | Nichols et al. | |
| 2004/0071303 | A1 | * | 4/2004 | Furuya et al. | 381/182 |
| 2004/0071309 | A1 | * | 4/2004 | Furuya et al. | 381/424 |
| 2004/0105565 | A1 | | 6/2004 | Butters et al. | |
| 2004/0252859 | A1 | * | 12/2004 | Saiki | 381/386 |
| 2005/0018868 | A1 | | 1/2005 | Chick et al. | |
| 2005/0111673 | A1 | | 5/2005 | Rosen et al. | |
| 2007/0025565 | A1 | | 2/2007 | Kim et al. | |
| 2007/0127760 | A1 | * | 6/2007 | Saiki et al. | 381/351 |
| 2007/0275769 | A1 | * | 11/2007 | Ho et al. | 455/569.1 |

FOREIGN PATENT DOCUMENTS

| | | |
|---|---|---|
| WO | 98/20659 | 5/1998 |

OTHER PUBLICATIONS

International Search Report and Written Opinion dated May 18, 2009 for PCT/US2009/036022.
International Preliminary Report on Patentability dated Oct. 7, 2010 for PCT/US2009/036022.

* cited by examiner

*Primary Examiner* — Elvin G Enad
*Assistant Examiner* — Alexander Talpalatskiy
(74) *Attorney, Agent, or Firm* — Bose Corporation

(57) ABSTRACT

Acoustic devices that include passive radiators. The passive radiator may include an acoustic driver. The acoustic device may be hand-held or pocket sized.

26 Claims, 6 Drawing Sheets

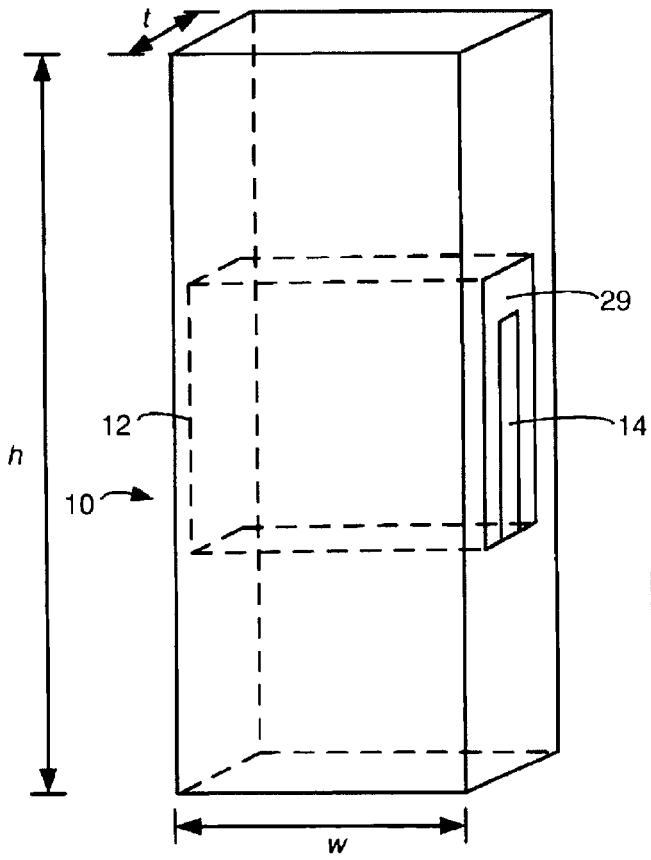
FIG. 1
FIG. 2
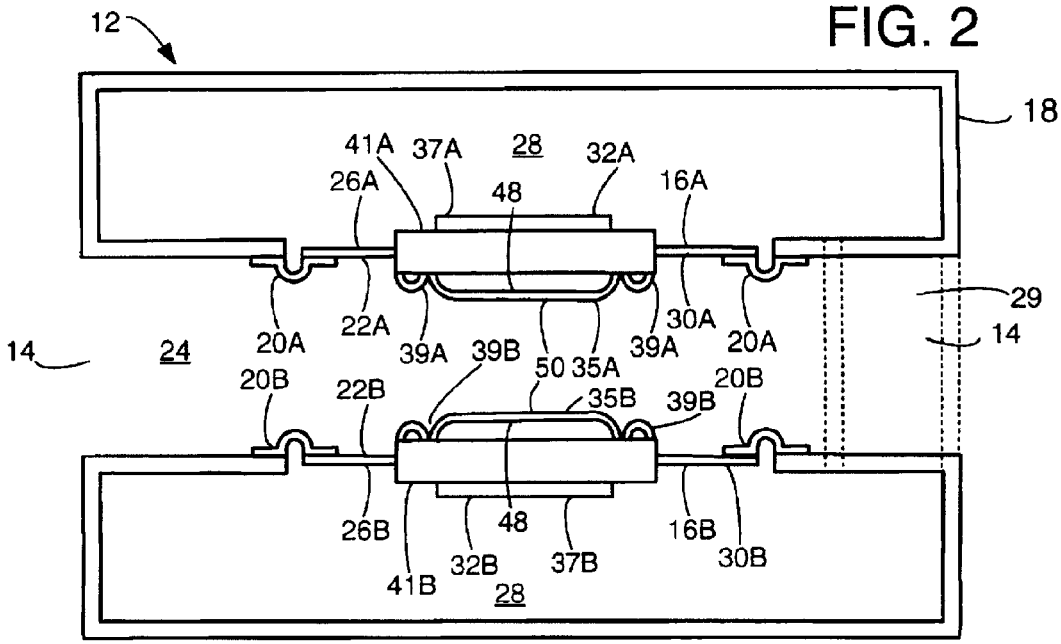

ACOUSTIC PASSIVE RADIATING

BACKGROUND

This specification describes an acoustic structure with passive radiators. A specific embodiment describes the structure applied to a hand-held portable acoustic reproduction device, such as a cell phone, a BlackBerry® device, a portable media storage device, a pager, or a personal data assistant (PDA) or the like.

SUMMARY

In one aspect an acoustic device includes a first acoustic driver and a first passive radiator structure. The first acoustic driver and the first passive radiator structure are mounted in a pocket sized enclosure. The first passive radiator structure may include the acoustic driver. The acoustic driver may include a magnet structure comprising a high energy product magnet material. The acoustic device may include a second passive radiator structure. The mass of the second passive radiator structure may be substantially equal to the mass of the first passive radiator structure. The second passive radiator structure may include a second acoustic driver. The first passive radiator structure and the second passive radiator structure may radiate into a common cavity. The acoustic device may be configured so that in operation the low frequency vibration of the first passive radiator structure and the low frequency vibration of the second passive radiator structure are acoustically in phase and mechanically out of phase. The acoustic device may further including a suspension element to couple the passive radiator structure to an enclosure. The passive radiator structure may include a connecting element to mechanically couple the suspension element and the passive radiator structure. The connecting element may be nonplanar so that the plane of attachment of the suspension element to the connecting element is nonplanar with the plane of attachment of the connecting element to the acoustic driver. The ratio of the depth of the acoustic driver to the diameter may be less than 0.5. The ratio of the depth of the acoustic driver to the diameter may be less than 0.2. The depth of the acoustic driver may be less than 10 mm.

In another aspect, acoustic structure includes an enclosure defining a cavity and a first passive radiator structure and a second passive radiator structure mechanically coupled to the enclosure and acoustically coupled to the cavity. At least one of the first passive radiator structure and the second passive radiator structure include an acoustic driver. The acoustic driver may include a magnet structure comprising a high energy product magnet material. The acoustic structure may be sized to fit in a pocket sized device. The enclosure may further define a first enclosed chamber acoustically coupled to the first acoustic driver and a second enclosed chamber acoustically coupled to the second acoustic driver. The first enclosed chamber and the second enclosed chamber may be acoustically coupled by an acoustic port acting as a low pass filter. The acoustic structure may be configured so that the first passive radiator device and the second passive radiator device vibrate acoustically in phase and mechanically out of phase. The acoustic device may further include a suspension element to couple the at least one of the first passive radiator and the second passive radiator structure to the enclosure. The passive radiator structure may include a connecting element to mechanically couple the suspension element and the passive radiator structure. The connecting element may be nonplanar so that the plane of attachment of the suspension element to the connecting element is nonplanar with the plane of attachment of the connecting element to the acoustic driver. The ratio of the depth of the acoustic driver to the diameter may be less than 0.5. The ratio of the depth of the acoustic driver to the diameter may be less than 0.2. The depth of the acoustic driver may be less than 10 mm.

In another aspect, an acoustic device may include components for radiating a non-bass spectral portion of a first stereo channel from a first side of a pocket sized device, which may include a first passive radiator structure driven by pressure variations in a first chamber acoustically coupled to a first cavity. The first cavity may be acoustically coupled to an opening in the first side of the device. A first acoustic driver may be acoustically coupled to the first chamber for radiating acoustic energy into the first chamber. The first acoustic driver may be acoustically coupled to a first stereo channel. The acoustic device may further include components for radiating a non-bass spectral portion of a second stereo channel from a second side of the pocket sized device opposite the first side, which may include a second passive radiator structure driven by pressure variations in a second chamber acoustically coupled to a second cavity. The second cavity may be acoustically coupled to an opening in the second side of the device. A second acoustic driver may be acoustically coupled to the second chamber for radiating acoustic energy into the second chamber. The second acoustic driver may be acoustically coupled to a second stereo channel. The first passive radiator structure may include the first acoustic driver. The second passive radiator structure may include the second acoustic driver. The first chamber and the second chamber may be acoustically coupled by an acoustic port which acts as a low pass filter. The acoustic device may further include circuitry to combine the bass spectral portions of the first stereo channel and the second stereo channel to provide a monaural bass signal and to transmit the monaural bass audio signal to the first acoustic driver and the second acoustic driver.

In another aspect, an acoustic device includes an enclosure defining a cavity, a first and second passive radiator assembly, acoustically coupled to the environment through the cavity, and a first acoustic driver, acoustically coupled to the environment through the cavity. The acoustic device may further include a second acoustic driver acoustically coupled to the environment through the cavity. The first passive radiator assembly may include the first acoustic driver and the second passive radiator assembly may include the second acoustic driver. The first passive radiator assembly may include the first acoustic driver.

Other features, objects, and advantages will become apparent from the following detailed description, when read in connection with the following drawing, in which:

BRIEF DESCRIPTION OF THE SEVERAL VIEWS OF THE DRAWING

FIG. 1 is a diagrammatic view of a hand held electronic device;

FIG. 2 is a diagrammatic view of an acoustic reproduction device;

DETAILED DESCRIPTION

Figure 3A:
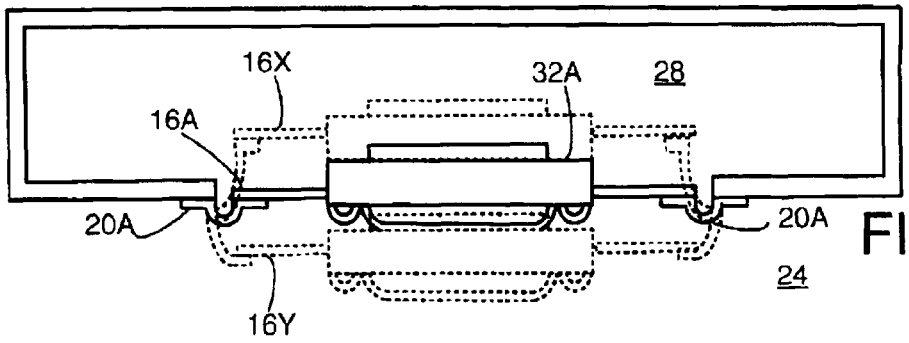
FIGS. 3A and 3B are diagrammatic views of a part of the acoustic reproduction device of FIG. 2.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Unless otherwise indicated, audio signals or video signals or both may be encoded and transmitted in either digital or analog form; conventional digital-to-analog or analog-to-digital converters may not be shown in the figures. For simplicity of wording "radiating acoustic energy corresponding to the audio signals in channel x" will be referred to as "radiating channel x."

FIG. 1 shows a hand-held electronic device 10. Incorporated in hand-held and/or pocket sized electronic device 10 is an acoustic reproduction device 12 acoustically coupled to the environment through openings 14 (only one of which is visible in this view). Duct 29 will be discussed below. In addition to radiating sound directly to the environment, the electronic device 10 may be configured to transmit audio signals to playback devices such as headphones or loudspeakers. FIG. 1 is for illustrative purposes and is not drawn to scale. A typical hand-held and/or pocket sized device has dimensions of h<15 cm, w<8 cm, and t(thickness)<5 cm, and preferably much smaller, for example in the range of h=13 cm, w=5 cm, and t=3 cm.

FIG. 2 shows the acoustic reproduction device 12 in more detail. A passive radiator assembly 16A is mounted in the enclosure 18 of the acoustic reproduction device 12 so that one surface 22A of the passive radiator assembly faces cavity 24 and one surface 26A faces chamber 28. The passive radiator assembly 16A is mechanically coupled to the enclosure by a suspension element 20A so that the passive radiator assembly 16A can vibrate relative to the enclosure 18 as will be seen below. For simplicity, suspension elements 20A and 20B below are shown as half-roll surrounds. In some embodiments, the suspension element may be a surround of the type described in U.S. patent application Ser. No. 11/756,119. In order to more clearly show two openings 14, chamber 28 appears as two distinct parts. It is preferable that both passive radiator assemblies 16A and 16B are driven by pressure changes in a common chamber (and that both acoustic drivers receive a common, that is monaural, bass signal as shown below in FIG. 5B), so in an actual implementation, what appears as the two chamber sections may be acoustically coupled by a duct 29. The passive radiator assembly 16A includes a passive radiator diaphragm 30A and an acoustic driver 32A. The acoustic driver 32A includes an acoustic driver diaphragm 35A mechanically coupled to the acoustic driver the acoustic driver motor structure 37A by acoustic driver suspension 39A so that the acoustic driver diaphragm 35A can vibrate relative to the acoustic driver motor structure 37A as will be shown below. The acoustic driver also includes a motor structure which includes a magnet structure 41A, which may include a high energy product material as will be discussed below. Similarly, a passive radiator assembly 16B is mounted in the enclosure 18 of the acoustic reproduction device 12 so that one surface 22B of the passive radiator structure faces cavity 24 and one surface 26B faces chamber 28. The passive radiator assembly 16B is mechanically coupled to the enclosure by a suspension element 20B so that the passive radiator assembly 16B can vibrate relative to the enclosure 18 as will be seen below. The passive radiator assembly 16B includes a diaphragm 30B and an acoustic driver 32B. The acoustic driver 32B includes an acoustic driver diaphragm 35B mechanically coupled to the acoustic driver the acoustic driver motor structure 37B by acoustic driver suspension 39B so that the acoustic driver diaphragm 35B can vibrate relative to the acoustic driver motor structure 37B as will be shown below. The acoustic driver also includes a motor structure which includes a magnet structure 41B, which may include a high energy product material as will be discussed below. One surface 50 of the diaphragm of each acoustic driver is acoustically coupled to the cavity 24, and a second surface 48 of the diaphragm of each acoustic driver is acoustically coupled to the chamber 28.

Figure 3B:
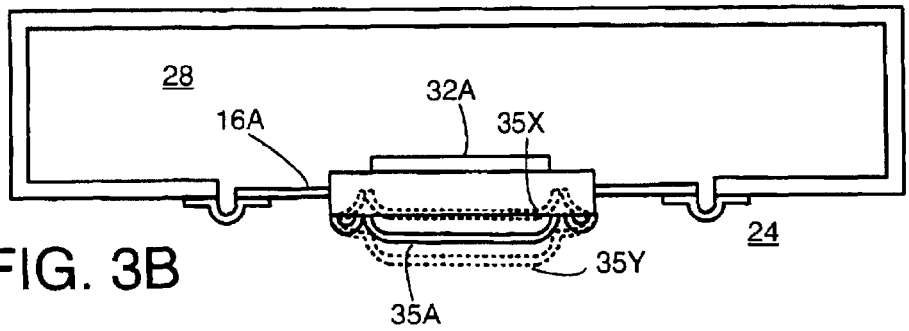

FIGS. 3A and 3B illustrate the operation of the passive radiator assembly 16A. In FIG. 3A, it is shown that the passive radiator assembly 16A, including the acoustic driver 32A vibrates (as indicated by dotted line passive radiator assemblies 16X and 16Y; for explanation purposes, the distance between extreme positions 16X and 16Y are greatly exaggerated), responsive to pressure changes in chamber 28, and radiates acoustic energy into cavity 24. Suspension element 20A permits motion as indicated in FIG. 3A, but opposes motion in a lateral direction. The acoustic driver 32A is a part of the mass and surface area of the passive radiator assembly 16A and radiates acoustic energy into the cavity 24 as a part of the passive radiator assembly 16A.

In addition, as illustrated in FIG. 3B, the diaphragm 35A of the acoustic driver 32A vibrates (as indicated by dotted line diaphragms 35X and 35Y) responsive to audio signals (not shown) relative to other parts of the passive radiator assembly 16A. The vibration of the diaphragm 35A radiates acoustic energy into cavity 24 and into chamber 28. The acoustic energy radiated into chamber 28 causes pressure changes in chamber 28, which in turn causes passive radiator assembly 16A to vibrate and radiate acoustic energy into the cavity 24 as described above. The acoustic energy radiated into the cavity 24 by the vibration of the passive radiator assembly 16 and the acoustic energy radiated into the cavity by the vibration of the acoustic driver diaphragm 35A relative to other parts of the passive radiator assembly is radiated to the external environment through openings 14 of FIG. 2. Passive radiator assembly 16B operates in a similar manner and is not shown in this view.

Since both passive radiator assemblies 16A and 16B are driven by pressure changes in a common enclosure 28, both passive radiators move in phase acoustically. However, due to the orientation of the two passive radiator assemblies, the two passive radiators move out of phase mechanically.

When the mechanical stiffness of the air in chamber 28 dominates the stiffness of the suspension element 20, the tuning frequency $F_{pr}$ of the passive radiator is given by $$F_{pr} = \frac{1}{2\pi} S_{pr} \sqrt{\frac{\rho c_0^2}{M_{pr} V}},$$

by where $S_{pr}$ is the effective radiating area of the passive radiator, ρ is the density of air, $c_0$ is the speed of sound in air, $M_{pr}$ is the mass of the passive radiator, and V is the acoustic volume of the chamber 28. For a desired tuning frequency $F_{pr}$ and a desired acoustic output (which is related to the efficiency of the acoustic driver), the volume V of the chamber 28, the effective radiating area $S_{pr}$ of the passive radiator assembly, and total moving mass $M_{pr}$ of the passive radiator assembly 16 can be adjusted to achieve the desired tuning frequency. In a hand-held or pocket sized device, the volume of the chamber and the effective radiating area of the passive radiator assembly may be constrained by the size and geometry of the enclosure. If an acoustic driver with a conventional motor structure with a low energy magnet material such as ferrite or ceramic is used, the mass of magnet material needed to achieve a given motor efficiency may become so large that a desired tuning frequency cannot be achieved; or the mass of the motor structure can be limited to provide the desired tuning frequency, which may compromise the acoustic output of the acoustic device. In this situation, it may be desirable to use an acoustic driver with a motor structure including a high energy product magnet material (such as neodymium or samarium cobalt or the like). Use of high energy product magnet materials provides an acoustic driver that has low total mass for a given motor efficiency, and which therefore permits a desired tuning frequency and a desired acoustic output to be achieved. The use of high energy product magnet materials may also facilitate the use of low profile acoustic drivers, as will be discussed below in the discussion of FIG. 6D.

A device according to FIGS. 1-3B is advantageous for many reasons. The use of passive radiators permits pocket sized devices to radiate bass energy to lower frequencies and to radiate more total acoustic energy than can be radiated with conventional devices the same size. Sound quality and volume heretofore associated with larger loudspeakers can be attained with pocket sized loudspeakers and pocket sized devices having other functions, such as cell phones, personal digital assistants (PDAs), BlackBerry® devices, and portable media storage devices. Portable media storage devices such as MP3® players can serve as loudspeakers as well as sources of audio signals for headphones. Since the passive radiators move mechanically out of phase and mechanical vibrational forces are canceled, high levels of output can be achieved by small, lightweight devices without the small devices vibrating or "walking" due to the vibration. The openings 14 do not need to be near the mounting location of the driver, which is especially important for devices in which a large portion of the external surface is covered when the device is in use or is needed for other functions, such as display screens or keypads.

Figure 4A:
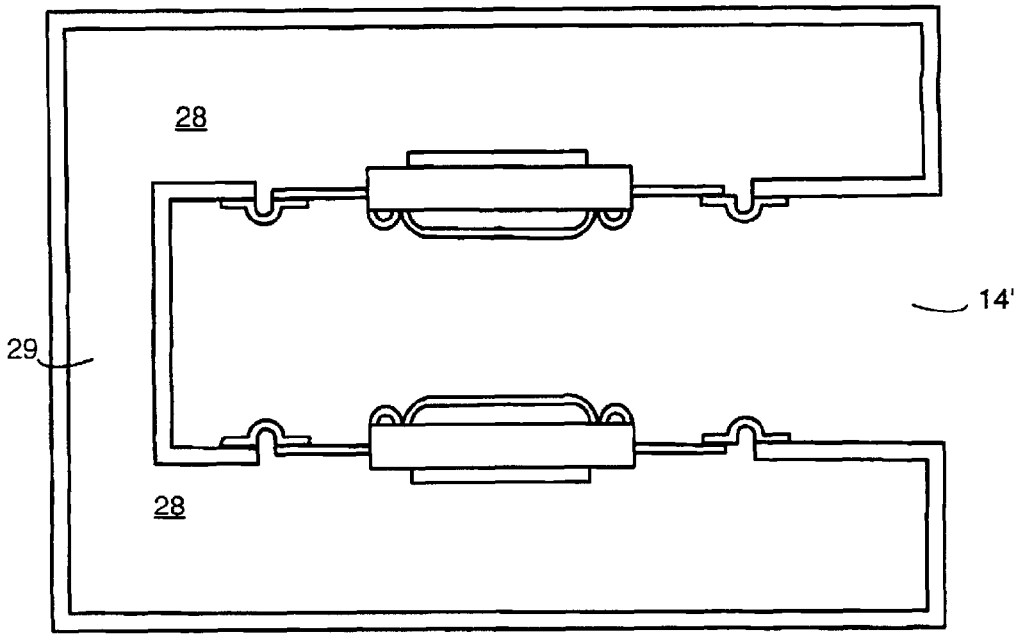
FIGS. 4A-4C are diagrammatic views of an acoustic reproduction devices.
Figure 4B:
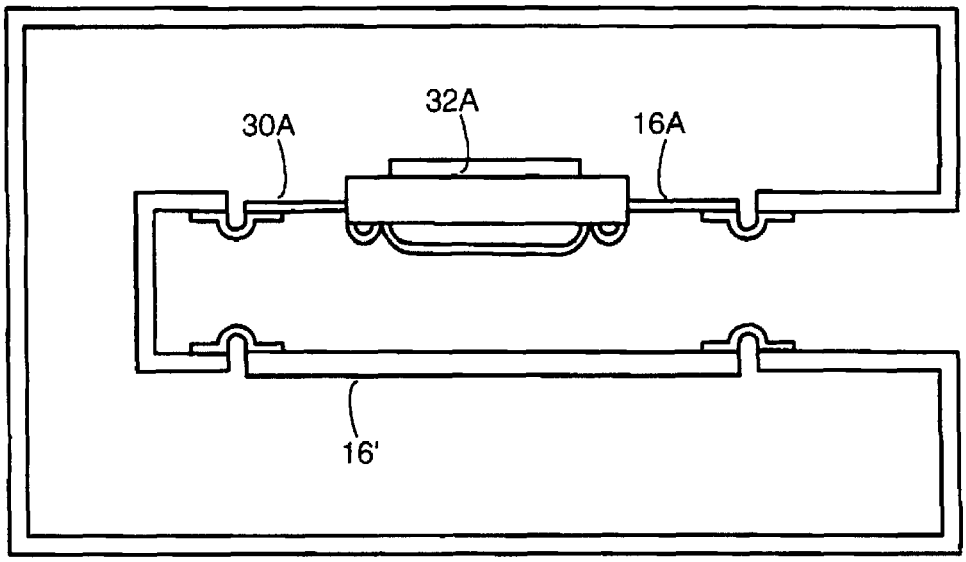
Figure 4C:
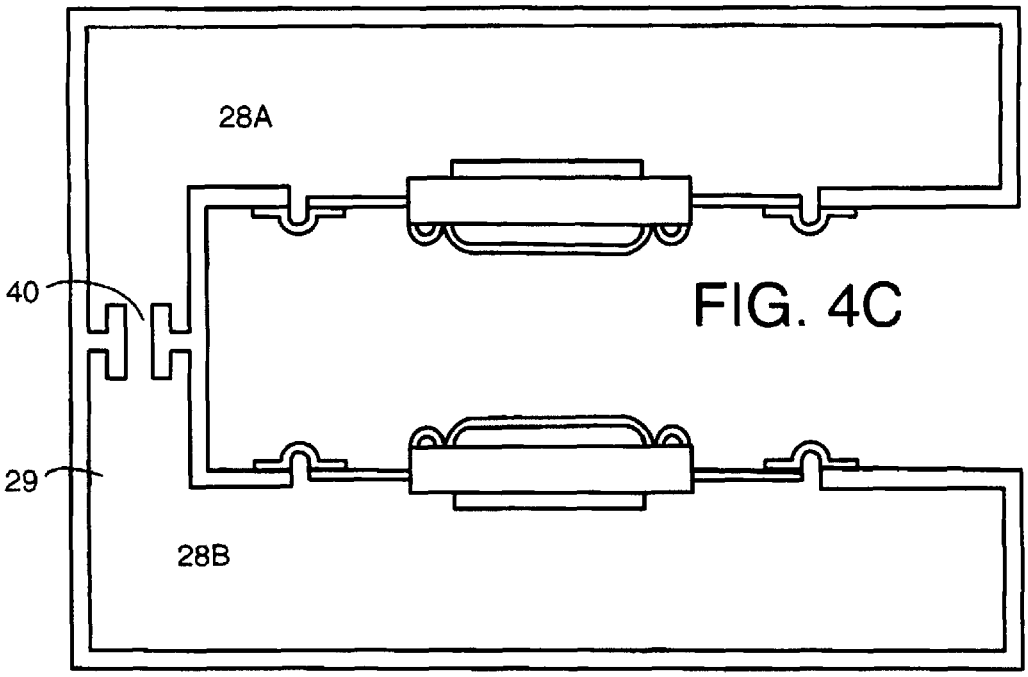

There are many possible variations on the devices of FIGS. 1-3B. Some of the variations are shown in FIGS. 4A-4C. In the acoustic reproduction device of FIG. 4A, instead of two openings 14, there is a single opening 14'. In the acoustic reproduction device of FIG. 4B, instead of two substantially identical passive radiator assemblies, there is one passive radiator assembly 16A similar to the passive radiator assemblies of FIGS. 1-3B and a second passive radiator 16' which does not incorporate an acoustic driver. Preferably, the second passive radiator 16' has the same mass as passive radiator assembly 16A, which includes the combined masses of the acoustic driver 32A (of FIG. 2) and of the passive radiator diaphragm 30A (of FIG. 2). Preferably, the second passive radiator 16' has the same effective radiating surface area as the passive radiator 16A, which includes the combined effective surface areas of acoustic driver 32A (of FIG. 2) and of passive radiator diaphragm (30A of FIG. 2). The configuration of FIG. 4B is especially suitable for monaural audio signal sources. In the acoustic reproduction device of FIG. 4C, chamber 28 has two subchambers 28A and 28B acoustically coupled by a port 40. The configuration of FIG. 4C is particularly suitable for stereophonic audio signal sources, as will be explained below.

Figure 5A:
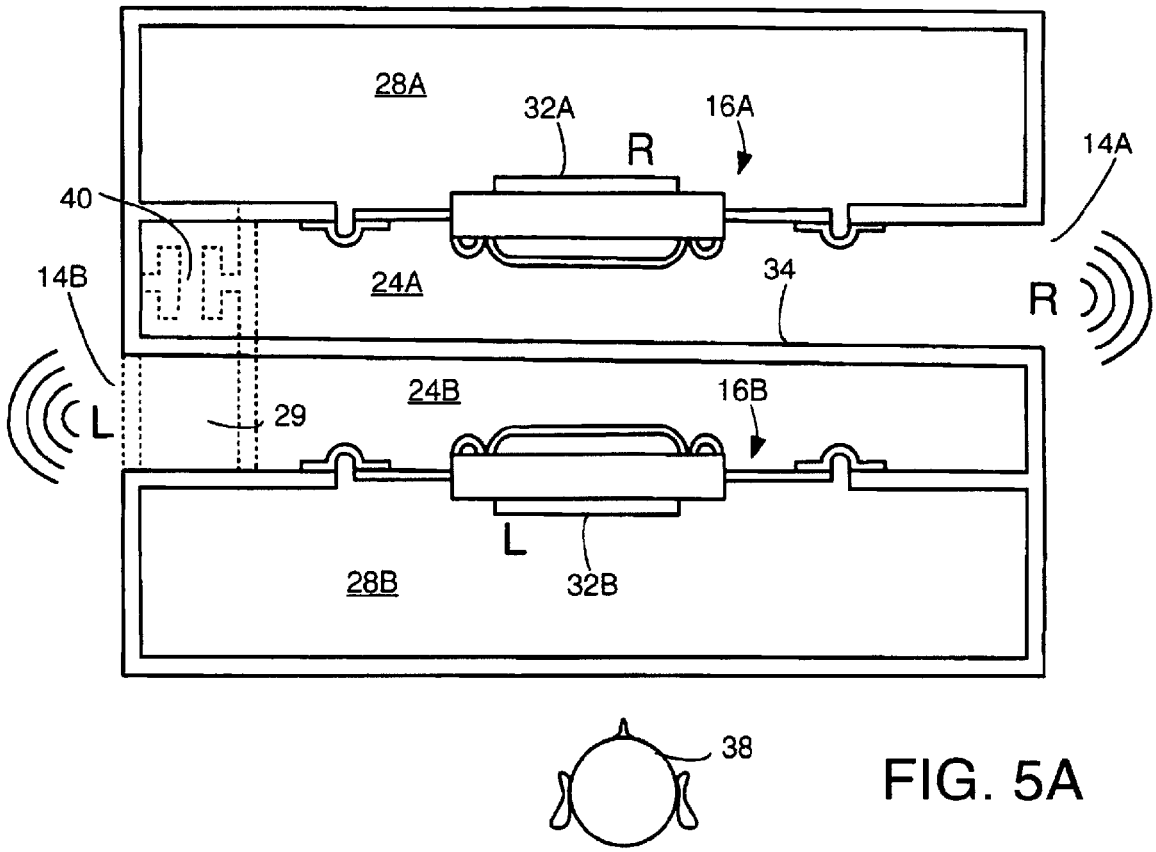
FIG. 5A is a diagrammatic view of an acoustic reproduction device.

FIG. 5A shows a hand held electronic device 36 that is particularly suited for use as a stereo audio reproduction device. In use, the stereo audio production device is oriented to the listener as indicated by indicator 38. In the device of FIG. 5A, cavity 24 of previous figures is divided into two subcavities 24A and 24B, which are separated by baffle 34, so that one subcavity exits through one side of the device and the other subcavity exits through the other side of the device. Chamber 28 of FIGS. 2-4B is divided into subchambers 28A and 28B, which are acoustically coupled by port 40, as shown above in FIG. 4C and described in the corresponding portion of the specification.

In operation, a right stereo channel audio signal is transmitted to right acoustic driver 32A. The right channel is radiated into subcavity 24A and into chamber 28A. The radiation into chamber 28A results in pressure changes in chamber 28A which cause passive radiator assembly 16A to vibrate and radiate the right channel into subcavity 24A. The right channel is radiated to the environment through right opening 14A as indicated by the "R" adjacent right opening 14A. A left stereo channel audio signal is transmitted to left acoustic driver 32B. The left channel is radiated into subcavity 24B and into chamber 28B. The radiation into chamber 28B results in pressure changes in chamber 28B which cause passive radiator assembly 16B to vibrate and radiate the left channel into subcavity 24B. The left channel is radiated to the environment through left opening 14B, as indicated by the "L" adjacent left opening 14B. The radiation of the right channel through the right opening 14A and the radiation of the left channel through the left opening 14B create a stereo effect, which can be increased by spatial processing techniques.

Figure 5B:
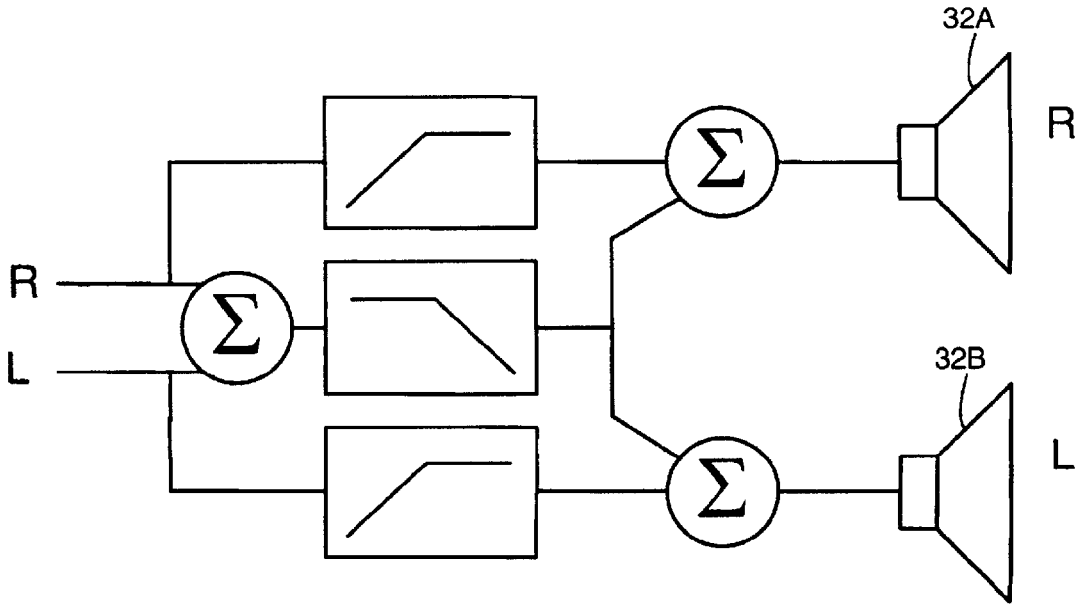
FIG. 5B is a block diagram of an audio signal processing circuit.

If desired, the bass portions of the left and right channels are combined as indicated in FIG. 5B to provide monaural base content. The right channel high frequency content is combined with the monaural bass content and transmitted to right acoustic driver 32A as indicated by the "R" adjacent right acoustic driver 32A. The left channel high frequency content is combined with the monaural bass content and transmitted to left acoustic driver 32B as indicated by the "L" adjacent left acoustic driver 32B. If the port 40 of FIG. 4D is added to the configuration of FIG. 5A, at frequencies in the bass range, the port 40 acts as a short circuit so that bass acoustic energy can pass back and forth between chamber 28A and chamber 28B. At frequencies above the tuning frequency of the port 40, the port 40 acts as an open circuit, so that high frequency acoustic energy does not pass between chamber 28A and 28B. The result is that the high frequency interaural phase difference cues are maintained, and the system is more tolerant of compliance and volume differences between the chambers 28A and 28B, which could affect the performance of the passive radiators 16A and 16B. Since the high frequency acoustic energy radiated by acoustic drivers 32A and 32B may be different and since the high frequency energy does not pass between chambers 28A and 28B, the high frequency acoustic energy, and therefore high frequency pressure changes, in chambers 28A and 28B may be different. Therefore, the high frequency pressure changes experienced by passive radiator assembly 16A may be different. However, passive radiator assemblies 16A and 16B may be designed to be significantly more responsive to low frequency pressure changes, which are substantially the same in chambers 28A and 28B. Therefore, as with implementations described above, passive radiator assemblies move acoustically in phase and mechanically out of phase.

The structures of FIGS. 2-5B can be incorporated in loudspeakers that are larger than handheld or pocket sized devices. For example, woofer sized loudspeakers can be designed with no exposed acoustic drivers which is advantageous cosmetically since there is no need for an external grille to cover an acoustic driver cone.

Figure 6A:
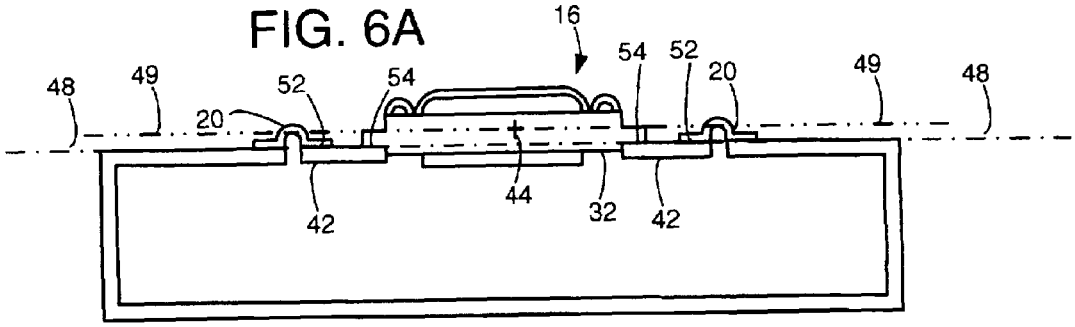
FIGS. 6A-6C are diagrammatic views of parts of audio reproduction devices.
Figure 6B:
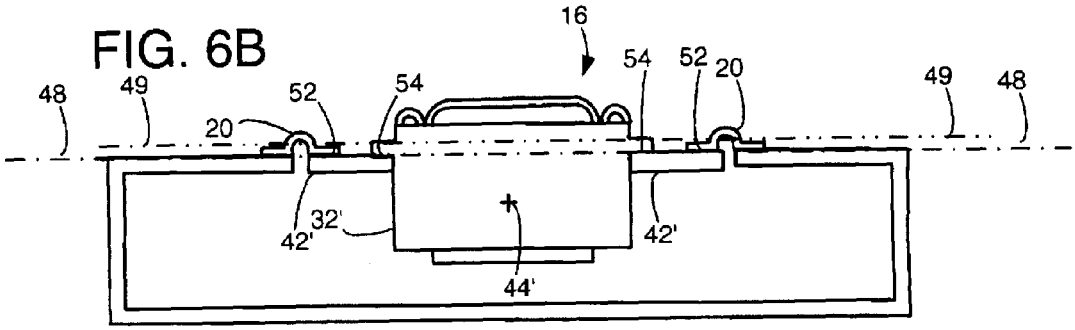
Figure 6C:
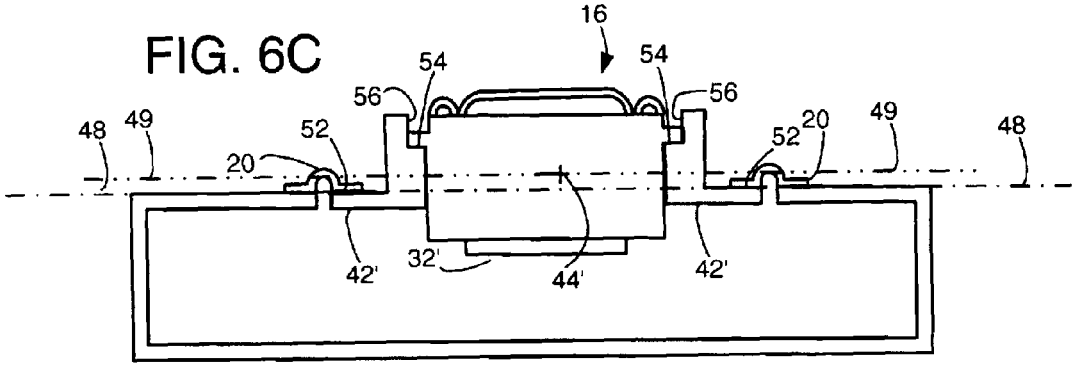
Figure 6D:
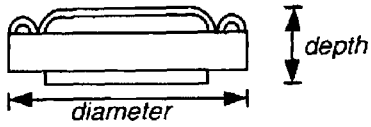
FIG. 6D is a diagrammatic view of an acoustic driver.

FIGS. 6A-6C show another aspect of the acoustic reproduction device 12. In the implementation of FIG. 6A, the passive radiator assembly 16 includes a connector ring 42 that mechanically couples the acoustic driver 32 and a simple suspension element, such as a half-roll surround with coplanar mounting pads. In the configuration of FIG. 6A, the mounting surface 52 for the suspension element pad and the mounting surface 54 for the acoustic driver are in the same plane, so that the point of attachment of the suspension element to the enclosure, the point of attachment of the suspension element to the connecting ring, and the point of attachment of the of the connecting ring to the acoustic driver all lie in the same plane 48. In FIG. 6A, the center of mass 44 of the passive radiator assembly 16 is near the rocking plane 49 of the suspension element which lies between plane 48 and the top of the arch of the suspension element 20. In FIG. 6B, the acoustic driver 32' has a different motor structure so that the center of mass 44' of the passive radiator assembly is not in or near rocking plane 49. The acoustic reproduction device of FIG. 6B is more susceptible than the device of FIG. 6A to rocking and other undesirable behavior, particularly if the acoustic reproduction device is used in a number of different orientations and/or is moved while the acoustic reproduction device is operating, as might be the case with a hand-held or pocket sized acoustic reproduction device. The acoustic reproduction device of FIG. 6C includes a connector ring 42' with a mounting surface 52 for the suspension element 20 that is nonplanar with the mounting surface 54 for the acoustic driver so that the center of mass 44' of the passive radiator assembly is closer to plane 49 than with the connecting ring of FIG. 6B. A nonplanar connecting ring gives the designer an extra tool to position the center of mass of the assembly nearer the rocking plane of the suspension element for better rocking stability. Alignment ring 56 will be described below. In addition to affecting the location of the center of mass relative to rocking plane 49, the connector ring 42, 42' has other uses. The dimensions, configuration, geometry, and material of the connector ring can be selected so that the combined mass of the acoustic driver, the mass of the connector ring, and the mass of other parts, if any, of the passive radiator 16 is the proper mass for the desired tuning of the passive radiator. The dimensions, configuration, geometry, and material of the connector ring can be selected so that the combined mass of the acoustic driver, the mass of the connector ring, and the mass of other parts, if any, of the passive radiator 16 has a desirable mass distribution. In addition, the connector ring may be configured to facilitate the attachment of the passive radiator assembly to the suspension element 20 and the attachment of the acoustic driver 32 to other elements of the passive radiator assembly 16. For example, the connector ring 42, 42' can be configured to provide a gluing surface that mates with a gluing surface on the suspension element 20. The connector ring can be configured so that the enclosure assembly, the suspension element 20A, and the connector ring can be assembled in a single manufacturing step, such as insert molding. The connector ring can be configured to accommodate acoustic drivers designed to be attached to other loudspeaker elements in different manners; for example, some acoustic drivers are designed to be attached to other loudspeaker elements by screws or bolts or similar fasteners, while other are designed to be attached to other loudspeaker elements by gluing or some similar attachment process. The connector ring enables the loudspeaker designer to select an acoustic driver based on its acoustic properties; fewer mechanical properties need to be considered than if the acoustic driver were directly connected to the suspension element. The connector ring may be configured so that simple suspension elements, such as a half-roll surround can be used, despite the weight distribution of the acoustic driver and the method of attachment and placement of attachment elements of the acoustic driver. The placement of the center of mass of the acoustic driver can be facilitated by the use of a shallow, low profile acoustic driver. The depth (see FIG. 6D) of the acoustic driver should be less than 20 mm and ideally less than 10 mm. The ratio of the depth of the acoustic driver to the diameter of the acoustic driver should be less than 0.5 and ideally less than 0.2.

Figure 7:
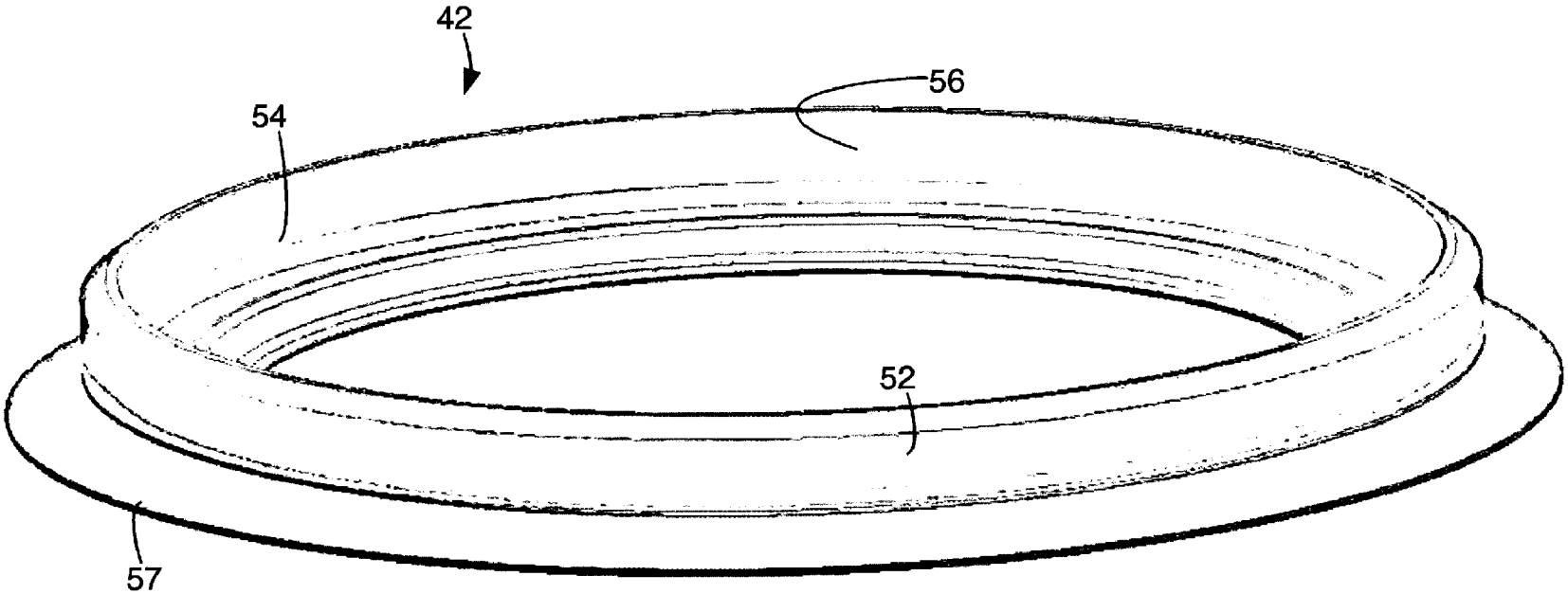
FIG. 7 is an isometric view of a connecting ring.

FIG. 7 shows a connector ring 42. Elements indicated by reference numbers in FIG. 7 correspond to like numbered elements of previous figures. Outer flange 57 provides required mass to the passive radiator assembly 18 without shifting the center of mass away from the plane of attachment 48 (see FIGS. 6A-6C) or the rocking plane 49 (see FIGS. 6A-6C). Inner flange 54 provides an attachment surface (in this case a gluing surface) for the acoustic driver. If the acoustic driver were designed to be attached in some other way, such as by fasteners, the inner flange could be redesigned accordingly. Inner ring surface 56 provides an alignment guide for insertion of the acoustic driver. Outer ring surface 52 provides an attachment surface (in this instance a gluing surface) for the suspension element 20.

Other embodiments are in the claims.

What is claimed is:

1. An acoustic device comprising:

a pocket sized acoustic enclosure;

a first passive radiator structure comprising a first passive radiator diaphragm, mounted to the pocket sized enclosure by a first passive radiator suspension which permits motion of the first passive radiator diaphragm relative to the pocket sized enclosure, responsive to pressure changes in the pocket sized enclosure; and a first acoustic driver mounted to the first passive radiator diaphragm so that the first acoustic driver vibrates with the first passive radiator diaphragm, responsive to pressure changes in the pocket sized enclosure, the first acoustic driver comprising a first acoustic driver diaphragm, mounted to the first acoustic driver so that the first acoustic driver diaphragm vibrates relative to other parts of the first acoustic driver.

2. An acoustic device according to claim 1, wherein the first acoustic driver comprises a magnet structure comprising a high energy product magnet material.

3. An acoustic device according to claim 1, further comprising a second passive radiator structure.

4. An acoustic device according to claim 3, wherein the mass of the second passive radiator structure is substantially equal to the mass of the first passive radiator structure.

5. An acoustic device according to claim 4, further comprising a second passive radiator structure comprising a second passive radiator diaphragm, mounted to the pocket sized enclosure by a suspension which permits motion of the passive radiator diaphragm relative to the pocket sized enclosure, responsive to pressure changes in the pocket sized enclosure; and a second acoustic driver mounted to the second passive radiator diaphragm so that the second acoustic driver vibrates with the second passive radiator diaphragm, responsive to pressure changes in the pocket sized enclosure, the second acoustic driver comprising a second acoustic driver diaphragm, mounted to the second acoustic driver so that the second acoustic driver diaphragm vibrates relative to other part of the second acoustic driver.

6. An acoustic device according to claim 3, wherein the first passive radiator structure and the second passive radiator structure radiate into a common cavity.

7. An acoustic device according to claim 3, configured so that in operation the low frequency vibration of the first passive radiator diaphragm and the low frequency vibration of the second passive radiator diaphragm are acoustically in phase and mechanically out of phase.

8. An acoustic device according to claim 1, further including a suspension element to couple the passive radiator structure to the pocket sized enclosure, the passive radiator structure comprising a connecting element to mechanically couple the suspension element and the passive radiator structure.

9. An acoustic device according to claim 8, wherein the connecting element is nonplanar so that a plane of attachment of the suspension element to the connecting element is nonplanar with the plane of attachment of the connecting element to the acoustic driver.

10. An acoustic device according to claim 1, wherein the ratio of a depth of the acoustic driver to a diameter is less than 0.5.

11. An acoustic device according to claim 1, wherein the ratio of a depth of the acoustic driver to a diameter is less than 0.2.

12. An acoustic device according to claim 10, wherein the depth of the acoustic driver is less than 10 mm.

13. An acoustic structure, comprising:

an enclosure defining a cavity;

a first passive radiator structure and a second passive radiator structure mechanically coupled to the enclosure and acoustically coupled to the cavity, the first passive radiator structure and the second passive radiator structure comprising a first passive radiator diaphragm and a second passive radiator diaphragm, respectively, the first passive radiator diaphragm and the second passive radiator diaphragm mounted to the enclosure by a suspension which permits motion of the first passive radiator diaphragm and the second passive radiator diaphragm relative to the enclosure, responsive to pressure changes in the enclosure;

an acoustic driver mounted to one of the first passive radiator diaphragm and the second passive radiator diaphragm so that the at least one acoustic driver vibrates with the passive radiator diaphragm to which it is mounted, responsive to pressure changes in the enclosure, the at least one acoustic driver comprising an acoustic driver diaphragm, mounted to the at least one acoustic driver so that the second acoustic driver diaphragm vibrates relative to other parts of the at least one acoustic driver.

14. An acoustic structure according to claim 13, wherein the acoustic driver comprises a magnet structure comprising a high energy product magnet material.

15. An acoustic structure according to claim 13, sized to fit in a pocket sized device.

16. An acoustic structure according to claim 13, the enclosure further defining a first enclosed chamber acoustically coupled to the first acoustic driver and a second enclosed chamber acoustically coupled to the second acoustic driver, the first enclosed chamber and the second enclosed chamber acoustically coupled by an acoustic port acting as a low pass filter.

17. An acoustic structure according to claim 13, configured so that the first passive radiator diaphragm and the second passive radiator diaphragm vibrate acoustically in phase and mechanically out of phase.

18. An acoustic device according to claim 13, further including a suspension element to couple the at least one of the first passive radiator diaphragm and the second passive radiator diaphragm to the enclosure, the passive radiator structure comprising a connecting element to mechanically couple the suspension element and the passive radiator structure.

19. An acoustic device according to claim 18, wherein the connecting element is nonplanar so that the plane of attachment of the suspension element to the connecting element is nonplanar with the plane of attachment of the connecting element to the acoustic driver.

20. An acoustic device in accordance with claim 13, wherein the ratio of the depth of the acoustic driver to the diameter is less than 0.5.

21. An acoustic device according to claim 20, wherein the ratio of the depth of the acoustic driver to the diameter is less than 0.2.

22. An acoustic device according to claim 20, wherein the depth of the acoustic driver is less than 10 mm.

23. An acoustic device comprising:

a pocket sized enclosure;

components for radiating a non-bass spectral portion of a first stereo channel from a first side of the pocket sized enclosure, comprising a first passive radiator structure comprising a first passive radiator diaphragm, mounted to the pocket sized enclosure by a first passive radiator suspension which permits motion of the first passive radiator diaphragm relative to the pocket sized enclosure responsive to pressure variations in a first chamber acoustically coupled to a first cavity, the first cavity acoustically coupled to an opening in the first side of the enclosure;

a first acoustic driver, acoustically coupled to the first chamber for radiating acoustic energy into the first chamber, the first acoustic driver coupled to a first stereo channel; and components for radiating a non-bass spectral portion of a second stereo channel from a second side of the pocket sized enclosure opposite the first side, comprising a second passive radiator structure comprising a second passive radiator diaphragm, mounted to the pocket sized enclosure by a second passive radiator suspension which permits motion of the second passive radiator diaphragm relative to the pocket sized enclosure responsive to pressure variations in a second chamber acoustically coupled to a second cavity, the second cavity acoustically coupled to an opening in the second side of the enclosure; and a second acoustic driver, acoustically coupled to the second chamber for radiating acoustic energy into the second chamber, the second acoustic driver coupled to a second stereo channel; wherein the first acoustic driver is mounted to the first passive radiator diaphragm so that the first acoustic driver vibrates with the first passive radiator diaphragm, responsive to pressure changes in the pocket sized enclosure, and wherein the first acoustic driver comprises a first acoustic driver diaphragm, mounted to the first acoustic driver so that the first acoustic driver diaphragm vibrates relative to other part of the first acoustic driver.

24. An acoustic device according to claim 23, the second passive radiator wherein the second acoustic driver is mounted to the second passive radiator diaphragm so that the second acoustic driver vibrates with the second passive radiator diaphragm, responsive to pressure changes in the pocket sized enclosure and wherein the second acoustic driver comprises a second acoustic driver diaphragm, mounted to the second acoustic driver so that the second acoustic driver diaphragm vibrates relative to the second acoustic driver.

25. An acoustic device according to claim 23, the first chamber and the second chamber acoustically coupled by an acoustic port, the port acting as a low pass filter.

26. An acoustic device comprising:

components for radiating a non-bass spectral portion of a first stereo channel from a first side of a pocket sized device comprising a first passive radiator structure driven by pressure variations in a first chamber acoustically coupled to a first cavity, the first cavity acoustically coupled to an opening in the first side of the device;

a first acoustic driver acoustically coupled to the first chamber for radiating acoustic energy into the first chamber, the first acoustic driver coupled to a first stereo channel; and components for radiating a non-bass spectral portion of a second stereo channel from a second side of the pocket sized device opposite the first side, comprising a second passive radiator structure driven by pressure variations in a second chamber acoustically coupled to a second cavity, the second cavity acoustically coupled to an opening in the second side of the device; and a second acoustic driver acoustically coupled to the second chamber for radiating acoustic energy into the second chamber, the second acoustic driver coupled to a second stereo channel, the acoustic device further comprising circuitry to combine the bass spectral portions of the first stereo channel and the second stereo channel to provide a monaural bass signal and to transmit the monaural bass audio signal to the first acoustic driver and the second acoustic driver.

* * * * *